US006427475B1

(12) United States Patent
DeFelice et al.

(10) Patent No.: US 6,427,475 B1
(45) Date of Patent: Aug. 6, 2002

(54) NESTED COOLER SYSTEM

(75) Inventors: Terry Robert DeFelice, Dublin; James R. Roberts, Pickerington, both of OH (US)

(73) Assignee: Abbott Laboratories, Abbott Park, IL (US)

( * ) Notice: Subject to any disclaimer, the term of this patent is extended or adjusted under 35 U.S.C. 154(b) by 0 days.

(21) Appl. No.: 09/213,680

(22) Filed: Dec. 17, 1998

(51) Int. Cl.[7] ..... F25D 3/08

(52) U.S. Cl. ..... 62/457.2

(58) Field of Search ..... 62/457.2, 457.3, 62/457.5, 457.7

(56) References Cited

U.S. PATENT DOCUMENTS

| | | | | |
|---|---|---|---|---|
| 2,825,208 | A | * | 3/1958 | Anderson |
| 4,050,581 | A | | 9/1977 | Sedlacek |
| 4,213,310 | A | | 7/1980 | Buss |

(List continued on next page.)

FOREIGN PATENT DOCUMENTS

| | | | |
|---|---|---|---|
| GB | 2225103 | A | * 11/1988 |
| GB | 2225103 | B | * 11/1988 |

OTHER PUBLICATIONS

Ross Products Diaper Bag Free Gift Coupon, Ross Products Division Literature, A8153/N12224 Jun. 1998.*

Ross Products Next Generation Instruction Bag with Cooler Insert, Ross Products Division Literature 61469 Sep. 1998.*

Ross Products Next Generation Instruction Bag, Ross Products Division Literature 60852 Apr. 1998.*

Mead Johnson® Breastfeeding Cooler Diaper Bag Instruction Product Brochure, N1006 NEW Feb. 1998.*

Ross Products Division Breastfeeding Support Cooler Bag Product Brochure, A7565 Apr. 1995.*

Ross Products Division Patient Instruction Packs A7577/ Apr. 1995.*

"Cooling Capacity of the Ross Pediatrics New Generation Instruction Bag with Cooler Insert Compared to the Mead Johnson Breastfeeding Success Bag," 1998 Ross Products Division Aug. 1998.*

"Cooling Capacity of the Ross Pediatrics Breastfeeding Support Cooler Bag and the Mead Johnson® Insert Compared to the Mead Johnson® Breastfeeding Success Bag," 60000/Ross Products Division Oct. 1997.*

"Cooling Capacity of the Ross Pediatrics Next Generation Instruction Bag with Cooler Insert," 61088/Ross Products Division Mar. 1998.*

"Breastfeeding and the Working Mother: Effect of Time and Temperature of Short–term Storage on Proteolysis, Lipolysis, and Bacterial Growth in Milk," *Pediatrics*, vol. 97, No. 4, Apr. 1996, pp, 492–498.*

Exhibit A, Mead Johnson Cooler–in–Bag System Photograpgh, circa Nov. 1998.*

Exhibit B, Mead Johnson Cooler–in–Bag System Photograph, circa Nov. 1998.*

The Next Generation Instruction Bag With Cooler Insert, Ross Products Division of Abbott Laboratories Inc., Sep. 1998 (*previously cited in Sep. 1998 examiner reference).

*Primary Examiner*—William Doerrler
*Assistant Examiner*—Melvin Jones
(74) *Attorney, Agent, or Firm*—Nickki L. Parlet

(57) ABSTRACT

A nested cooler system for temporary storage of perishable foodstuffs and more particularly to articles for convenient, temporary storage of human breast milk and infant formulas. The inner and outer coolers jointly or independently receive the perishable foodstuffs and freezable gel packs for cooling the perishable foodstuffs. The gel packs can be frozen and thawed several times and temporarily keep containers of milk within an acceptable temperature range to prevent spoilage. The gel packs fit within pockets in the coolers to maintain proper positioning of the gel packs relative to the bottles.

27 Claims, 8 Drawing Sheets

U.S. PATENT DOCUMENTS 4,295,345 A * 10/1981 Atkinson ..... 62/371
4,598,746 A * 7/1986 Rabinowitz
4,630,671 A 12/1986 Sherman et al.
4,796,758 A * 1/1989 Hauk
5,007,250 A * 4/1991 Musielak ..... 62/372
5,062,557 A * 11/1991 Mahvi et al.
5,140,833 A * 8/1992 Whalen ..... 62/457.7
5,230,450 A * 7/1993 Mahvi et al.
5,234,143 A * 8/1993 Mahvi et al.
5,257,509 A 11/1993 Harris
5,259,506 A 11/1993 Pascale et al.
5,318,107 A * 6/1994 Bell
5,390,797 A * 2/1995 Smalley
5,406,808 A * 4/1995 Babb et al.
5,421,172 A * 6/1995 Jones ..... 62/457.5
5,526,907 A * 6/1996 Trawick et al.
5,533,361 A 7/1996 Halpern
5,638,979 A 6/1997 Shea
5,758,513 A * 6/1998 Smith ..... 62/457.5
5,865,314 A * 2/1999 Jacober ..... 206/570

* cited by examiner

NESTED COOLER SYSTEM

FIELD OF INVENTION

This invention pertains to articles for temporary storage of perishable, edible foodstuffs, and more particularly to insulated articles for convenient, temporary storage of human breast milk and infant formulas.

BACKGROUND OF THE INVENTION

Coolers are commonly used to store food and beverage items that must be kept at low temperatures to prevent spoilage. Coolers are available in various sizes and shapes from the large hard-sided insulated chests to the individual soft-sided lunch sacks. These coolers are designed for the sole purpose of keeping perishable foodstuffs cold. Coolers generally have walls defining an interior cavity into which the foodstuff is placed. The walls are usually made of or contain an insulating material such as foam or air.

Specific concerns occur when transporting human breast milk or infant formula during a trip with the infant or when the nursing mother returns to work. Storing, transporting and chilling expressed human milk in the workplace creates several challenges. Discretion and safety are typical concerns when expressing milk in the workplace. Placing expressed milk in a communal refrigerator is indiscreet and provides opportunities for contamination or loss of the milk during the day. In many situations a communal refrigerator is not available, so the working woman carries a bulky ice chest to work, with the hope that the coolant packs will last long enough to drop the temperature of the expressed milk to prevent spoilage during work hours. When the parent is traveling with the baby and older siblings, storage of expressed milk or infant formula is not the only perishable food that the parent needs to think about. Other perishable foods for the older sibling must be carried along with all of the baby support supplies required. A second multi-compartment diaper bag typically fills the role of transporting additional baby support supplies. The parent ends up carrying multiple articles specialized for individual tasks.

U.S. Pat. No. 5,062,557 to Mahvi, et al., describes an infant care bag for storing bottles, diapers, wet wipes and other infant care supplies comprising a primary bag section and an adjacent removable auxiliary bag section. The primary bag section has a plurality of fixed adjacent compartments. At least one of the compartments is an insulated cooler compartment with fixed smaller compartments contained within. The primary bag section can also be used as a booster chair for dining. The removable auxiliary section provides additional storage space and has a compartment for storing a changing pad. The infant care bag is constructed of a fabric-coated extruded plastic framework.

U.S. Pat. No. 2,825,208 to Anderson describes a single-compartment portable refrigerated carrier, in particular a traveling bag having pockets for bottles of milk, baby food, and formula along with pockets for a refrigerant on the inner surface of the cover. Diapers, baby clothes and the like may be stored in the body of the bag.

U.S. Pat. No. 4,796,758 to Hauk describes a portable case to enable the chilling, storing and transportation of expressed human milk. The portable case includes several components, a durable and rugged case, a foam insulated chest, storage bottles and chilling means. The case has upper and lower compartments, wherein the upper compartment may be used to store a breast pump or similar device. The lower compartment houses the insulated chest. Within the insulated chest are three sturdy and unbreakable storage bottles that are chilled by coolant gel packs.

Ross Products Division, Abbott Laboratories Breastfeeding Support Cooler Bag is a single-compartment insulated soft-sided cooler. The insulated, zip-shut cooler bag includes two reusable 8-oz. gel packs that may be inserted into pockets located on the sides of the inner compartment.

Mead Johnson® Breastfeeding Success Bag contains a single compartment cooler attached to the bottom of a diaper bag. The cooler is designed to store previously chilled or frozen bottles of expressed breast milk for up to eight hours. Bottles of refrigerated or frozen breast milk are placed directly on top of the 16-oz. frozen ice pack in the zippered cooler compartment of the diaper bag.

There remains a need for a reliable, portable cooler that can be easily inserted in a larger cooler allowing the nursing mother to rely upon one system for safely storing expressed breast milk while at the workplace and easily adding the small storage cooler to a larger cooler for supplemental cold storage and convenience.

SUMMARY OF THE INVENTION

This invention pertains to a system for temporary storage of perishable, edible foodstuffs, and more particularly to articles for convenient, temporary storage of human breast milk and infant formulas. In accordance with the invention, the system includes two containers, an inner cooler nested within the outer cooler. The inner cooler contains cooling means for cooling foodstuffs while additional cooling means are optional for the outer cooler.

The inner cooler is capable of receiving items therewithin, as well as receiving cooling means that fit within the inner cooler. Preferably, the inner cooler panels are insulated to an R factor of at least about 0.29 and include at least one securing means for securing the cooling means within the cooler and closure means for selectively opening and closing the cooler to enable the removal and placement of items within the inner cooler. The first and optional second cooling means are typically capable of being repeatedly frozen and thawed.

The outer cooler is capable of receiving the inner cooler therewithin, as well as receiving optional cooling means that fit within the outer cooler. Ideally, the outer cooler panels are insulated to an R factor of at least 0.29. The outer cooler generally includes at least one securing means for securing the optional cooling means within the outer cooler and closure means for selectively opening and closing the outer cooler to enable the removal and placement of the inner cooler and optional cooling means as well as other items within the outer cooler. The optional third and fourth cooling means are typically capable of being repeatedly frozen and thawed. Additional means for securing items may be provided on the outside surface of the outer cooler.

The plurity of panels that define the interior space of the inner and outer cooler may further comprise a polyvinyl chloride vinyl inner- and outer-protective layer that sandwich a polyurethane foam filler intermediate layer. Typically the outer and inner PVC layers have a thickness from about 0.1 mm to about 0.5 mm and the intermediate polyurethane foam filler layer has a thickness from about 1.0 mm to about 10.0 mm.

An advantage of the present invention is the convenience of the nested cooler system. The inner cooler features a lightweight design and convenient handle. The attractive inner cooler may be easily carried along with a purse or brief case, making transportation of the container and milk therein convenient for the user. Additionally, the inner cooler may be simply placed in the outer cooler for outings with the children.

The present invention provides for removable cooling means. By being removable, the cooling means may be conveniently and inexpensively replaced as they wear out. In addition, an extra set of cooling means may be used so that one set is always frozen and can be placed into the cooler system when the first set of cooling means begins to lose its cooling capacity.

Additionally, the present invention may provide securing means within the inner and outer cooler. Such securing means provide sure placement of the cooling means relative to the items being stored. This increases the likelihood that each item will be maintained at the correct temperature regardless of jostling the coolers during transportation.

BRIEF DESCRIPTION OF THE DRAWINGS

The invention may take physical form in certain parts and arrangement of parts, a preferred embodiment of which will be described in detail in this specification and illustrated in the accompanying drawings (not to scale) that form a part hereof and wherein.

DESCRIPTION OF THE PREFERRED EMBODIMENT

As used herein, R value refers to a measure of insulating power or ability to resist the flow of heat. Higher R values mean greater insulating power. The R value for a particular material is the inverse of the thermal conductivity (K) of that material. K is the thermal conductivity in British Thermal Units (BTU) per hour, square foot, and temperature gradient of 1 degree Fahrenheit per inch thickness.

The lower the conductivity (K), the greater the insulating values. The sum of the R values of each material represented in a panel or packet provides a total R value for a specific panel or pocket.

For the purposes of the invention, non-insulating material is one with a very low or negligable R value, such as 0.1 mm thick PVC.

The terms second insulated container, larger container and outer cooler are used interchangeably and refer to the article that receives the inner cooler therewithin.

NESTED COOLER SYSTEM

Figure 1:
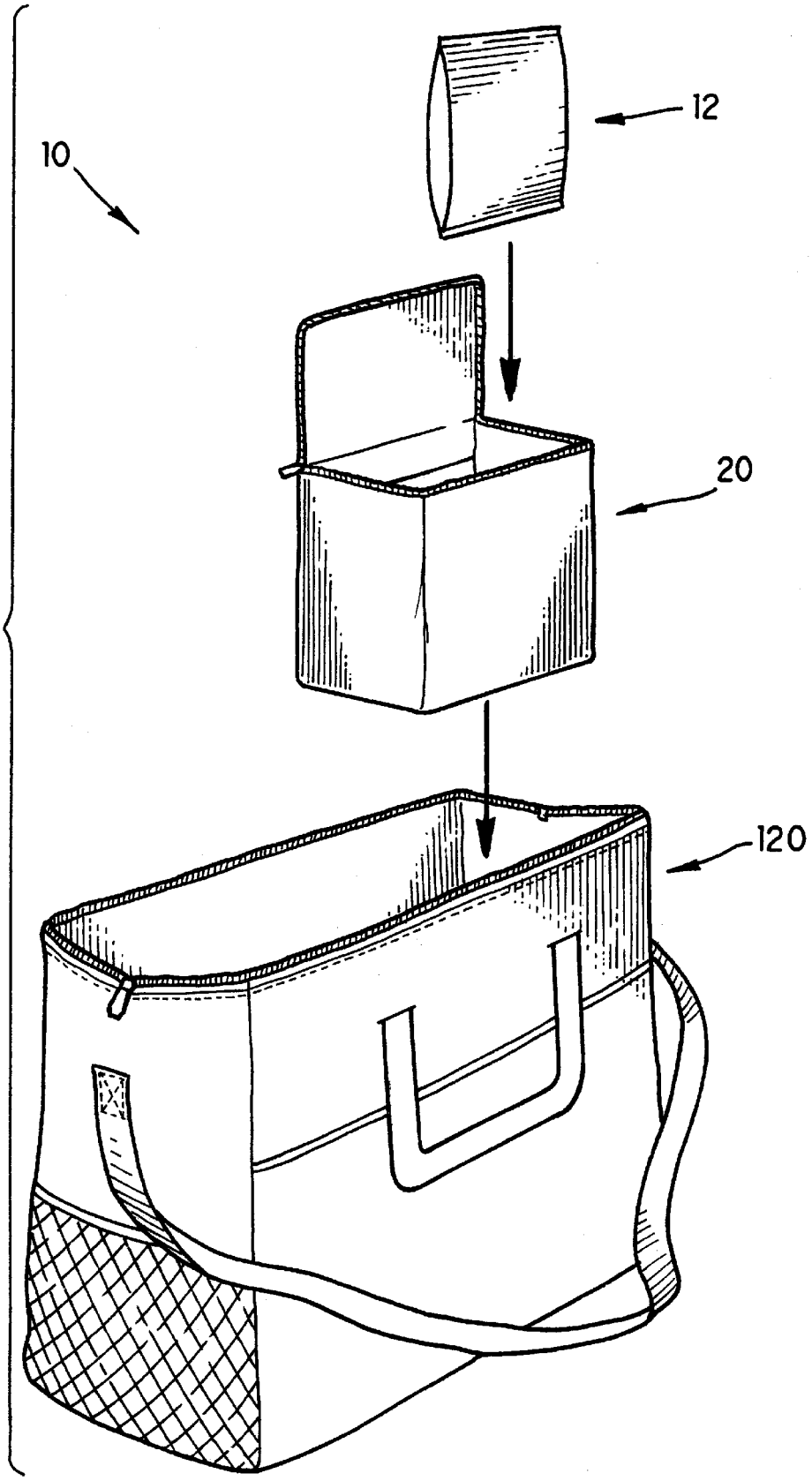
FIG. 1 is an exploded view of the nested cooler system 10.

Referring now to the drawings wherein the views are for purposes of illustrating a preferred embodiment of the invention only and not for purposes of limiting the same, FIG. 1 shows the nested cooler system 10 according to the invention. A frozen gel pack 12 is placed within the interior space of inner cooler 20 that is placed within the interior space of a second insulated container 120 (hereinafter outer cooler 120).

INNER COOLER

Figure 2:
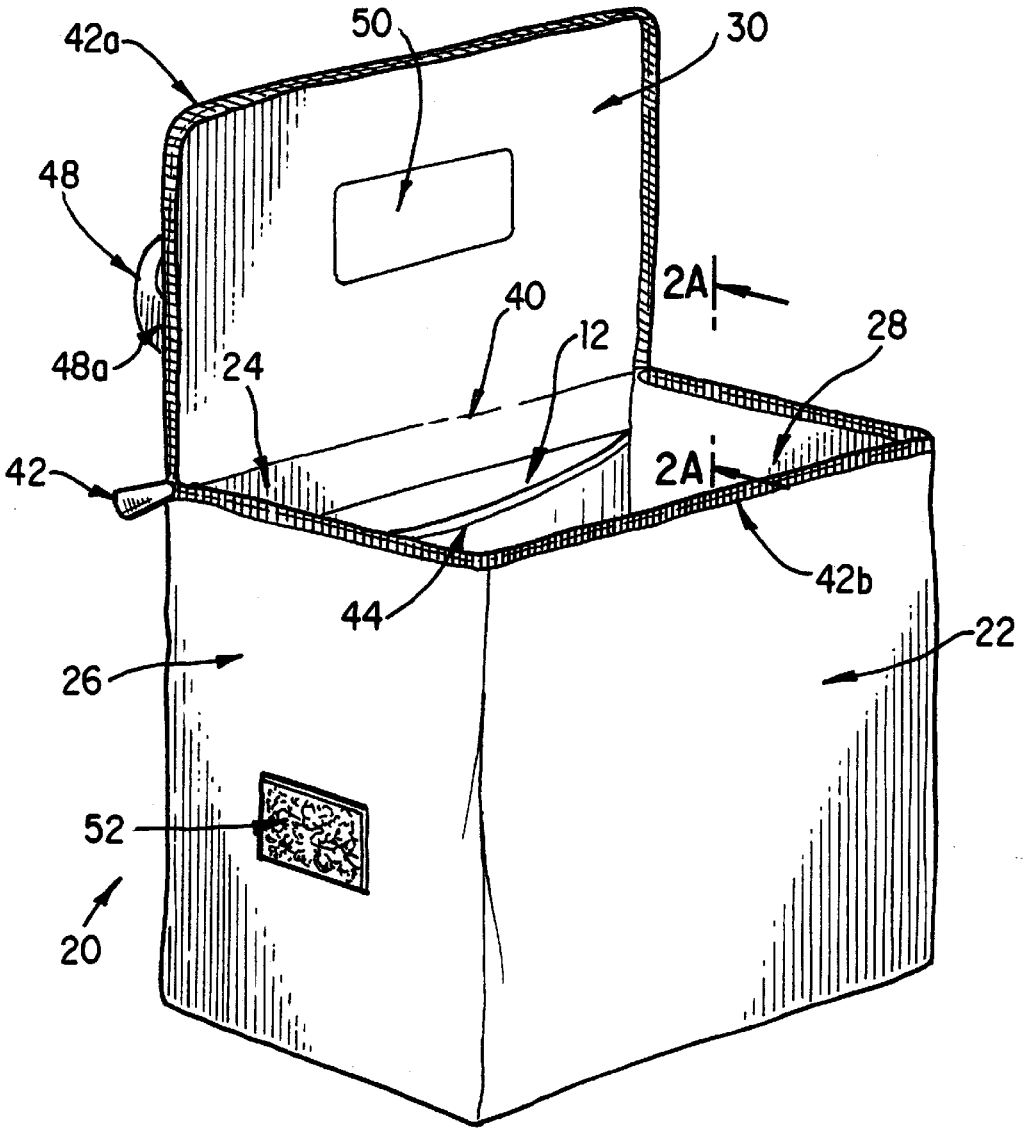
FIG. 2 is a perspective view of the inner cooler 20.

FIG. 2 shows the preferred inner cooler 20 according to the invention. The inner cooler 20 comprises a front panel 22; back panel 24; end panels 26, 28; top panel 30; and bottom panel 32. The panels are connected so as to define a first interior space.

One or more of the panels of the inner cooler comprise insulation material. The insulation comprises any material suitable to the application that provides an R value of at least about 0.29, preferably from about 0.29 to about 5.0, more preferably from about 0.58 to about 2.0, most preferably from about 0.72 to about 1.50. Materials that may be used to achieve the desired R value include but are not limited to closed cell foam, open cell foam, fiber insulators, air space, glass, mylar and combinations thereof. Different materials may be selected depending on the desired characteristics. For example, durability, final desired weight and size of the article, specific structure requirements, food grade status, cost of material and appearance are characteristics addressed by the selection of the insulation material. Obviously, a material with a low R value may require great thickness to achieve the desired insulation characteristic. Consequently, materials with low R values would not be as practical for this application. However, combinations of materials with varying physical characteristics and R values may achieve the desired characteristics and with the preferred R values. Preferably a polyurethane foam filler is selected as the insulation material. Some advantages of polyurethane foam filler are the insulation capacity, softness to the touch and its light weight.

The insulation capacity is important in achieving storage conditions appropriate for perishable foodstuffs and more specifically human breast milk. Human breast milk stored at various temperatures has been studied by Hamosh, et al., "Breastfeeding and the Working Mother: Effect of Time and Temperature of Short-Term Storage on Proteolysis, Lipolysis and Bacterial Growth in Milk," PEDIATRICS, Vol. 97, Pages 492–498 (1996). Hamosh, et al., evaluated the safety of stored human milk at various temperatures by assessing the microbial growth and stability of the milk protein and lipid at intervals up to 24 hours. They chose suboptimal storage conditions (temperatures of 15° C. to 38° C.) based on typical storage temperatures found in developing countries as well as in many work situations in industrialized countries. They found that human milk can be stored safely up to 24 hours at 59° F. (15° C.) and for up to four hours at 77° F. (25° C.) but that it should not be stored at 100.4° F. (38° C.).

Figure 2A:
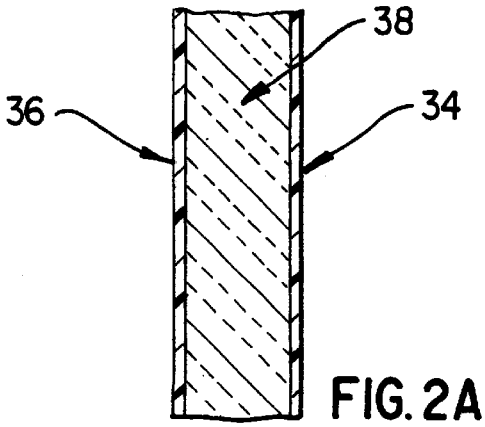
FIG. 2*a* is an enlarged cross sectional view of the preferred panel material.

The panels may further comprise inner and/or outer protective coverings (34,36) sandwiching the intermediate insulation layer 38 as shown in FIG. 2A. The inner and outer covering layers comprise any material suitable to the application, as described in more detail herein. Examples of material used as covering layers (34,36) include but are not limited to polyvinyl chloride (PVC), natural and man-made woven fabrics, plastic, urethane, foil, mylar and combinations thereof. Different materials may be selected depending on the desired characteristics. For example, food grade material may be desired on the inner layer where it may become in contact with foodstuffs. Ease of cleaning, durability, final weight and shape, cost of materials, and appearance of the article are additional characteristics to be addressed in the selection of suitable inner and outer coverings. The panels preferably comprise a polyvinyl chloride vinyl inner 34 and outer layer 36, with a polyurethane foam filler intermediate layer 38. The outer PVC layer 36 has a thickness from about 0.1 mm to about 0.5 mm, preferably from about 0.1 mm to about 0.3 mm. The inner PVC layer 34 has a thickness from about 0.1 mm to about 0.5 mm, preferably from about 0.1 mm to about 0.3 mm. The intermediate polyurethane foam filler layer 38 has a thickness from about 1.0 mm to about 10.0 mm, preferably from about 2.0 mm to about 8.0 mm, most preferably from about 4.0 mm to about 6.0 mm. Some advantages of PVC in the form of a vinyl sheet are the ease of cleaning and durability characteristics.

For the purposes of the invention, the R values represent the entire panel's insulation power. Consequently, the total insulation power of the panels of the inner cooler is the sum of the R values for the inner 34 and outer 36 PVC layers and the polyurethane foam filler intermediate layer 38. Since the R values for the preferred PVC layers are negligible compared to the polyurethane foam filler layer, the total R value is suitably approximated by the R value for the polyurethane foam filler layer.

The inner cooler 20 further comprises a closure means for selectively opening and closing the inner cooler 20. The closure means may be any material suitable to the application including but not limited to the hook and loop system such as Velcro™, magnetic, spring hinges, channel lock system with or without a slide such as a Ziploc™, snaps, draw string, zippers and combinations thereof. Different materials may be selected depending on the desired characteristics. For example, strength of seal, cost of material, durability and location of closure means on the article are additional characteristics to be addressed in the selection of suitable closure means. Obviously, the tighter sealing closure means promote better insulation of the interior space by decreasing the exchange of air between the interior space and external environment.

In the embodiment shown in FIG. 2, the preferred closure means is a zipper 42. The top panel 30 meets the back panel 24 to form an edge 40 that serves as a hinge. About the other three sides of the periphery of the top panel 30 is a zipper track 42*a* that cooperates with a mating zipper track 42*b* that is affixed about three sides of the periphery of the top of the front 22 and end panels 26,28 of the inner cooler. The zipper 42 enables the inner cooler to be selectively opened and closed so that containers of human breast milk or infant formula and cooling means may be selectively removed and replaced within the inner cooler in addition to minimizing the exchange of cooled air with the external environment.

The inner cooler may comprise securing means for securing cooling means adjacent to at least one panel. The securing means may be any material suitable to the application including but not limited to the hook and loop system such as Velcro™, straps, buckles, snaps, elastic, cord, pockets and combinations thereof. Different materials may be selected depending on the desired characteristics. For example, space available in the article, strength, location and R value are additional characteristics to be addressed in the selection of suitable securing means for securing cooling means.

In the embodiment shown in FIG. 2, the securing means is a first pocket 44. The first pocket 44 may be made of any material suitable to the application, for example mesh, natural and man-made woven fabrics, PVC vinyl, plastic sheets and combinations thereof. Different materials may be selected depending on the desired characteristics. For example, R value, strength and shape are additional characteristics to be addressed in the selection of suitable pocket material. Preferably the securing means is a single sheet of PVC vinyl located adjacent to the inside of back panel 24. The PVC vinyl of the pocket has a thickness from about 0.1 mm to about 0.5 mm, preferably from about 0.1 mm to about 0.3 mm. The configuration of the securing means illustrated in FIG. 2 with the securing means adjacent a back panel, is the presently preferred embodiment. However, there are other embodiments of the invention in which the securing means is located at an additional and/or a different place within the inner cooler. For example, with reference to FIG. 3, an alternate embodiment of the inner cooler includes a second pocket 46 placed inside the inner cooler adjacent to the front panel 22.

Figure 3:
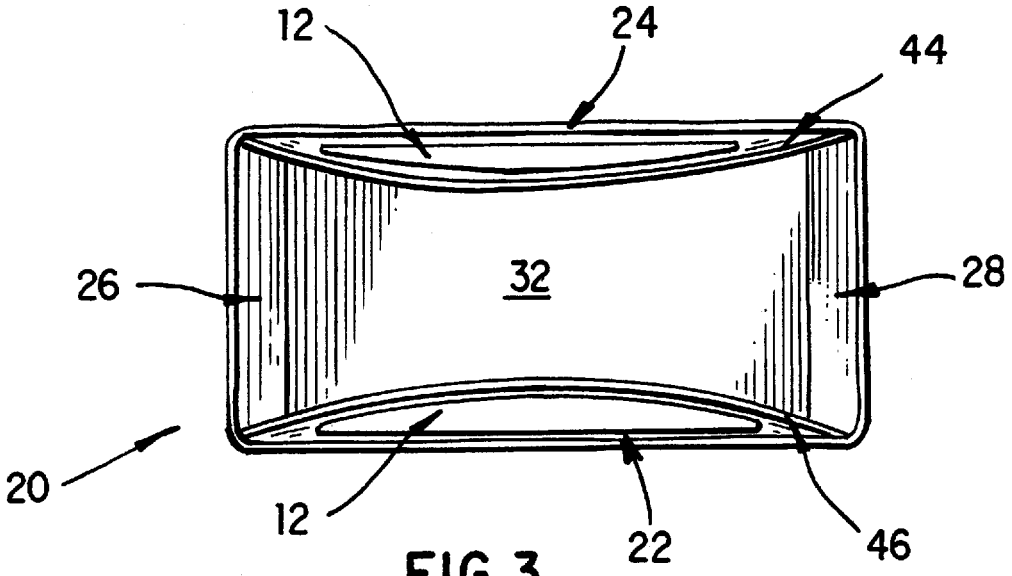
FIG. 3 is a cross section view of an alternate embodiment of the inner cooler 20.

With reference to FIGS. 1, 2 and 3, the preferred cooling means 12 is a gel pack. The preferred gel pack is available from Mid-Lands Chemical Company, Inc., Omaha, Nebr. and is sold under the trade name "Polar Pack." Preferably the gel packs are repeatedly frozen and thawed with no appreciable decrease in performance. Other cooling means could also be used successfully, for example, rigid or flexible packs of ice substitute refrigerant, ice, and rigid or flexible chemical coolant packs. Ice substitute refrigerant is typically an inert, nontoxic polymer that forms a lattice. The lattice determines the final viscosity that determines if the end product is a partial or hard freeze gel pack. Obviously, the hard freeze gel packs remain frozen longer and therefore are the preferred gel pack for longer term storage. The cooling means is at least one gel pack from about 4 oz. to about 18 oz., preferably at least one gel pack from about 6 oz. to about 16 oz., more preferably at least one gel pack from about 6 oz. to about 8 oz. Selection of the cooling means takes into consideration the insulation power of the panels (total R value), the foodstuffs to be chilled, the size and location of the space available for the cooling means within the cooler and the securing means for the cooling means. For the inner cooler, the most preferred cooling means is one eight ounce gel pack placed in pocket 44.

In the embodiment shown in FIG. 1 and 2, a handle 48 is depicted. One end 48*a* of handle 48 is affixed to one side of top panel 30 while other end 48*b* is affixed to the opposite side of the top panel 30. The handle may be made of any material suitable to the application, to include but not limited to PVC, natural and man made woven fabric, plastic, wood, metal, webbing, glass and combinations thereof. Different materials may be selected depending on the desired characteristics. For example, comfort of the handle in the hand, strength and appearance are additional characteristics to be addressed in the selection of suitable handle material. The preferred material for the handle is one inch wide polypropylene webbing.

An optional identification label 50 is affixed to the inner layer of the top panel 30. The label may be any material suitable to the application to include but not limited to PVC, natural and man made woven fabrics, paper, plastic, ink stamped onto the inner layer, embossing of the inner layer and combinations thereof. Different materials may be selected depending on the desired characteristics. For example, appearance, durability and ability to accept ink are additional characteristics to be addressed in the selection of suitable identification label material.

Optionally, the inner cooler 20 may further comprise securing means 52 on an outside surface of a panel for securing the inner cooler within the interior space of the outer cooler. Securing the inner cooler in a specific orientation permits the positioning of any non-insulated panels of the inner cooler 20 adjacent to an optional, secondary cooling means of the outer cooler to maximize cooling capacity. Those knowledgeable in the art may use any securing means suitable to the application. Optional securing means may include but are not limited to the hook and loop system such as Velcro™, straps, buckles, elastic, cord, snaps and pockets and combinations thereof. Different materials may be selected depending on the desired characteristics. For example, strength, space and location of securing means and R value are additional characteristics to be addressed in the selection of suitable securing means for securing the inner cooler within the interior space of the outer cooler. Preferably, the inner cooler is held in such an orientation by a hook and loop system.

OUTER COOLER

The outer cooler component 120 of the nested cooler system 10 provides for additional cooling capacity and insulation for food stuffs stored in the inner cooler as well as a second cooling compartment for foodstuffs within the outer cooler itself.

Figure 4B:
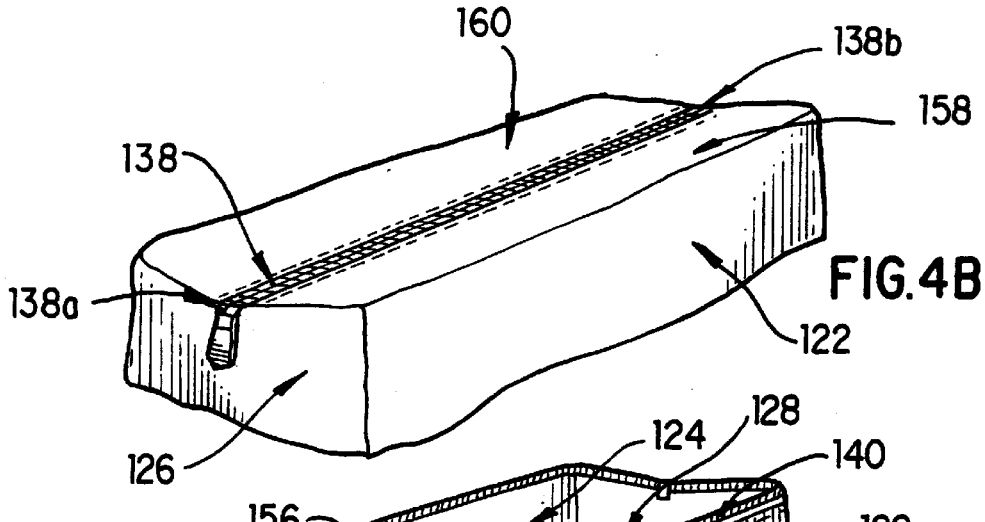
FIG. 4*b* is a perspective view of an alternate embodiment of the outer cooler 120.
Figure 4:
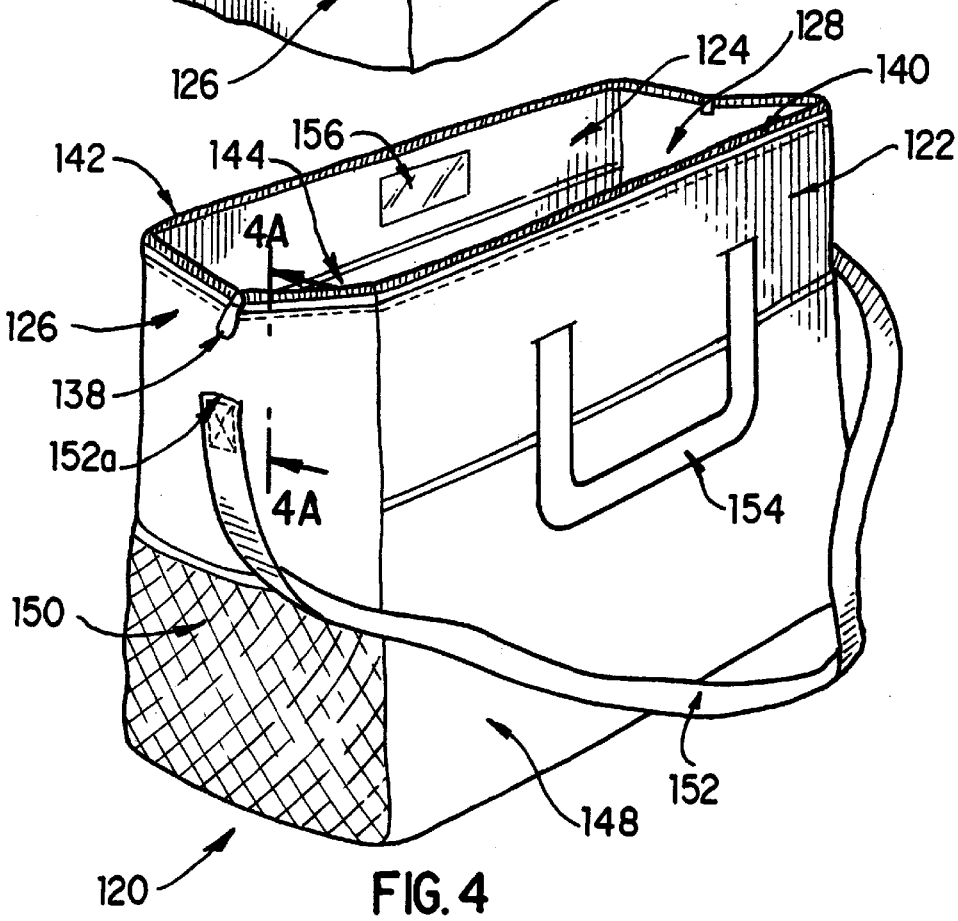
FIG. 4 is a perspective view of the outer cooler 120.

Referring now to FIG. 4 that shows the preferred outer cooler 120 according to the invention. The outer cooler comprises a front panel 122; back panel 124; end panels 126, 128; and bottom panel 130 connected so as to define a second interior space of greater capacity than the first interior space. One or more of the panels of outer cooler 120 are insulated with any material suitable to the application that provides an R value of at least about 0.29, preferably from about 0.29 to about 5.0, more preferably from about 0.58 to about 2.0, most preferably from about 0.72 to about 1.50. Materials that may be used to achieve the desired R value include but are not limited to closed cell foam, open cell foam, fiber insulators, air space, mylar, glass and combinations thereof. Different materials may be selected depending on the desired characteristics. For example, durability, final desired weight and size of the article, specific structure requirements, food grade status, cost of material and appearance are characteristics addressed by the selection of the insulation material. Obviously, a material with a low R value may require great thickness to achieve the desired insulation characteristic. Consequently, the materials with low R values would not be as practical for this application. However, combinations of materials with varying physical characteristics and R values many achieve the desired characteristics and with the preferred R values. Preferably a polyurethane foam filler is selected as the insulation material.

Figure 4A:
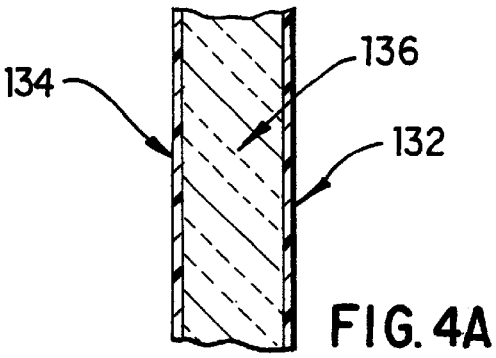
FIG. 4*a* is an enlarged cross sectional view of the preferred panel material.
Figure 6A:
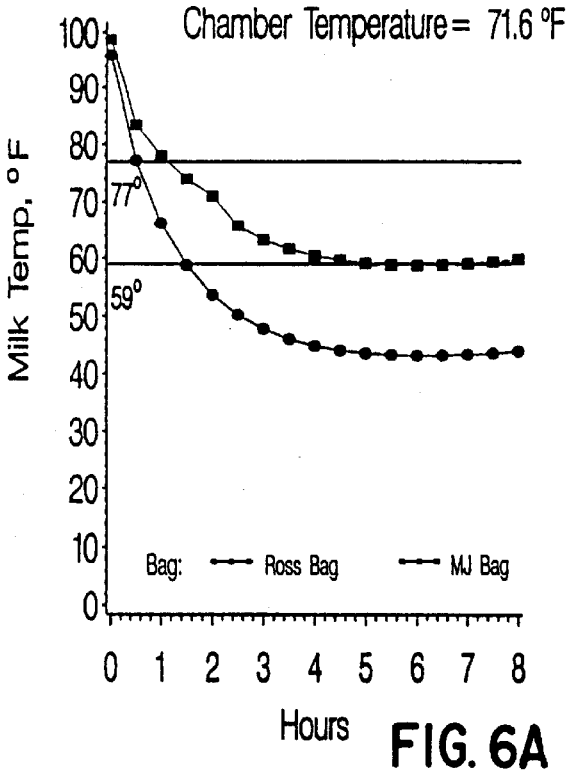
FIGS. 6A–P illustrate graphically the results of three cooling capacity studies plotted against the criteria of Hamosh, et al., for safe storage, as described in more detail in the examples.
Figure 6B:
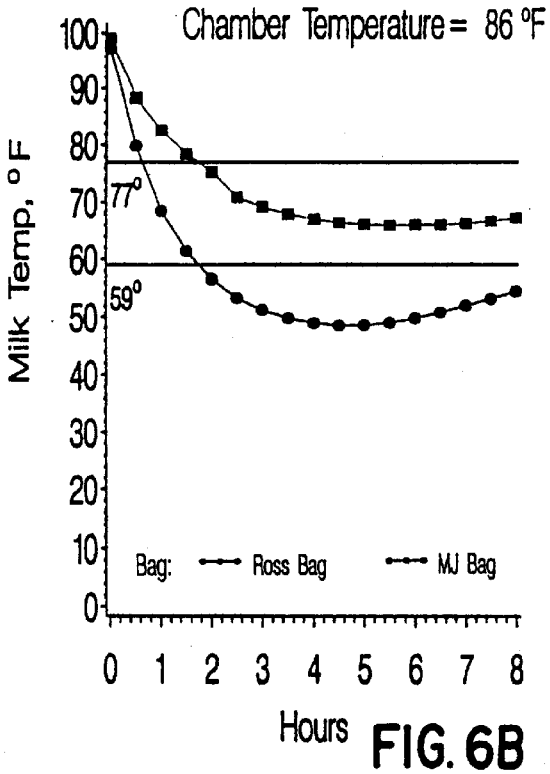
Figure 6C:
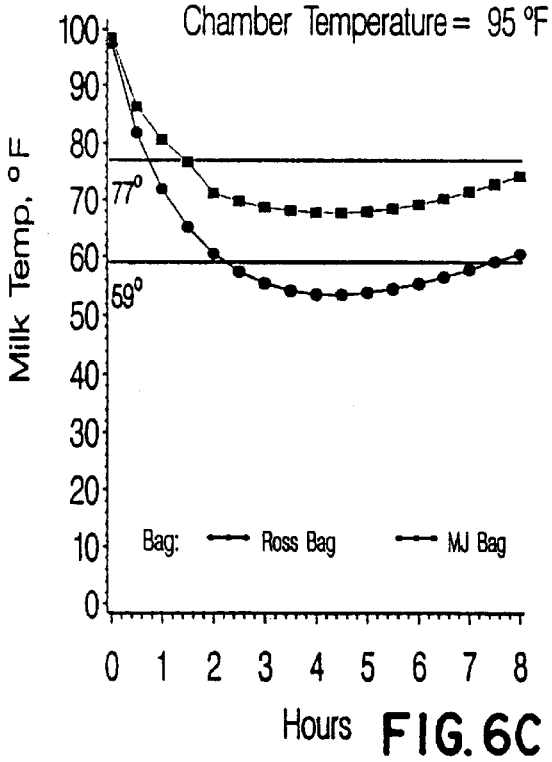
Figure 6D:
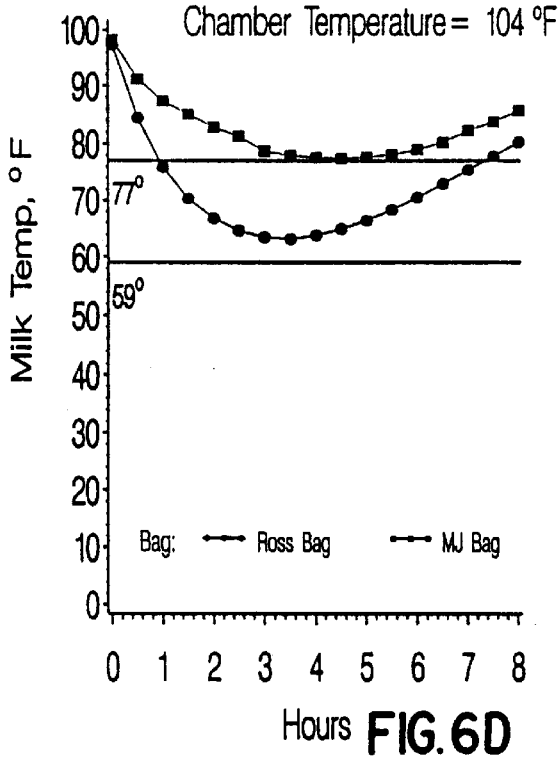
Figure 6E:
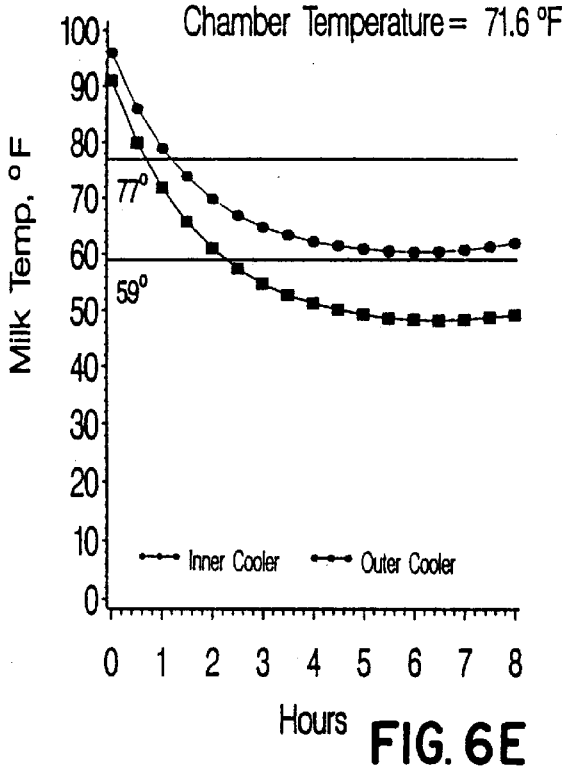
Figure 6F:
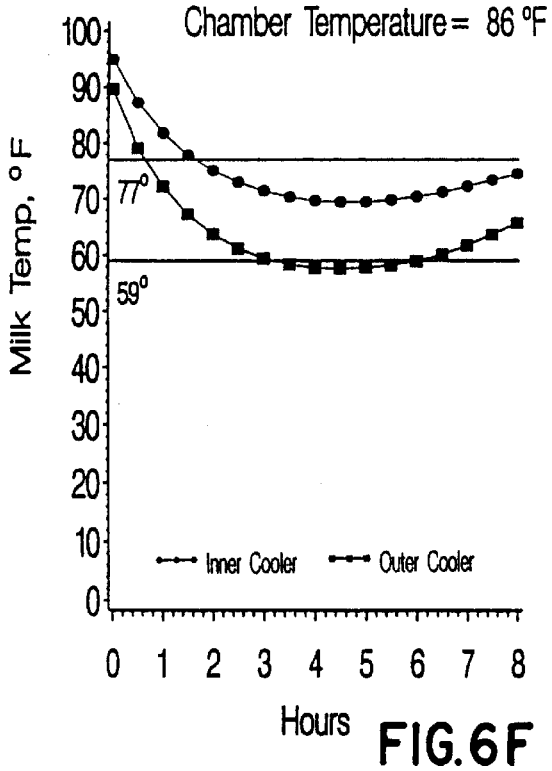
Figure 6G:
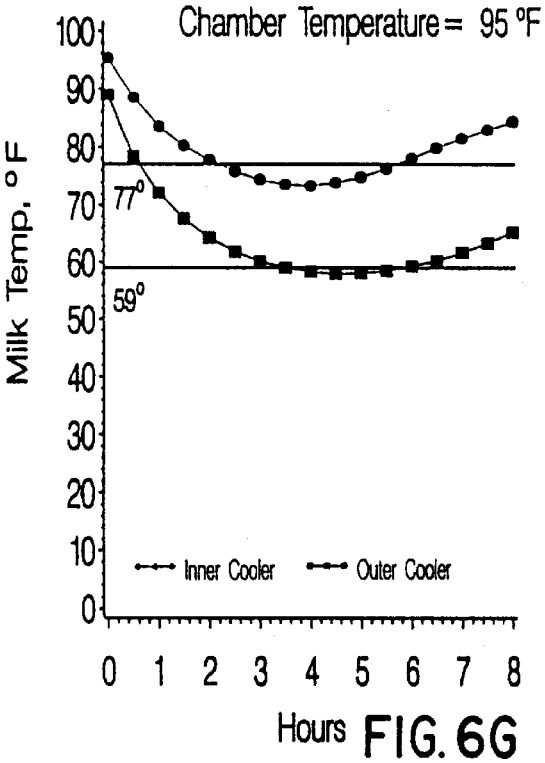
Figure 6H:
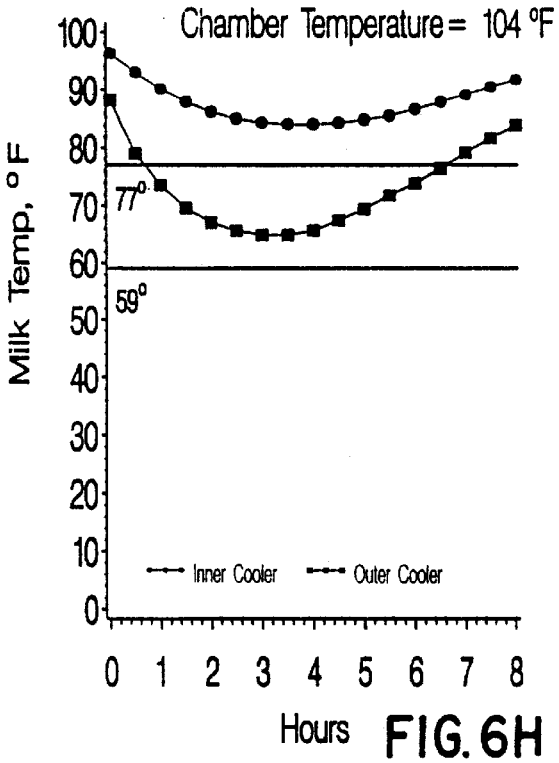
Figure 6I:
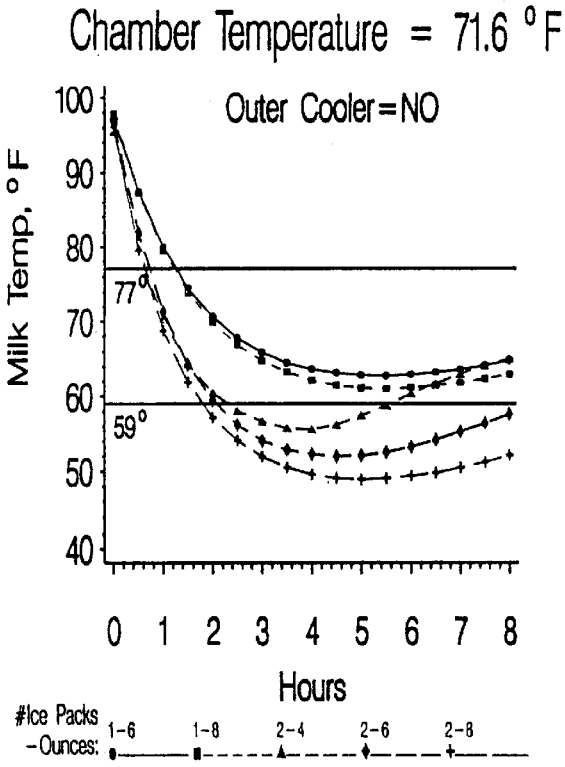
Figure 6J:
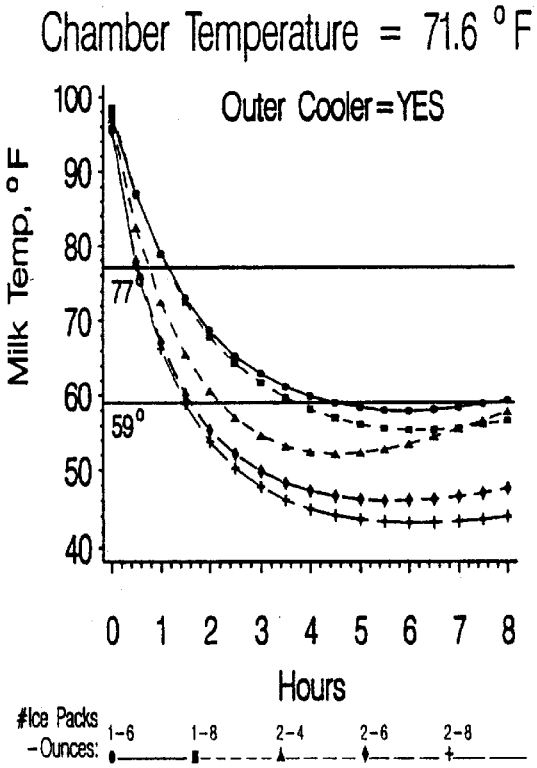
Figure 6K:
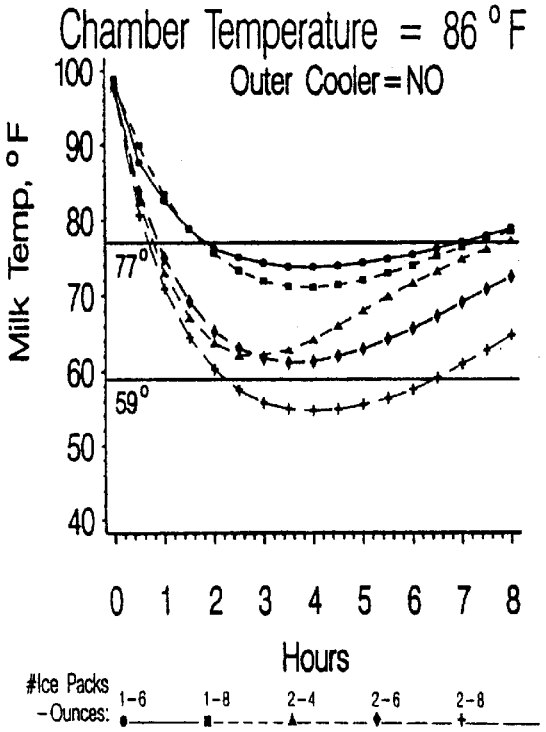
Figure 6L:
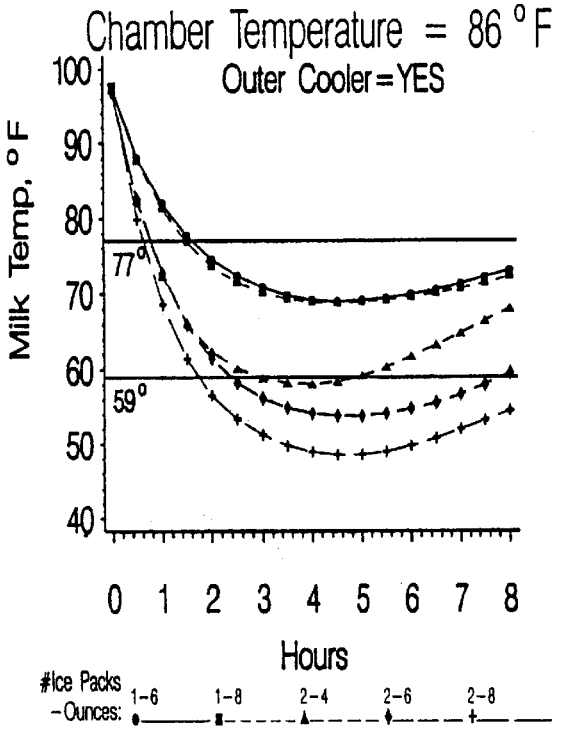
Figure 6M:
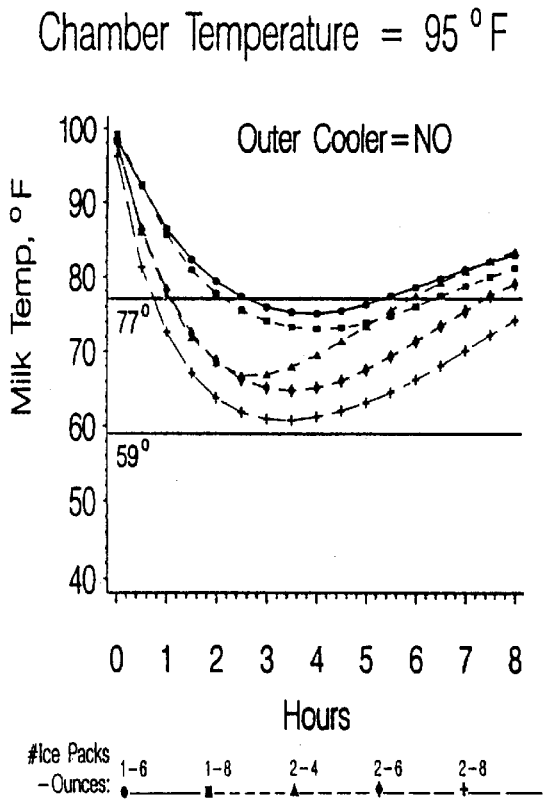
Figure 6N:
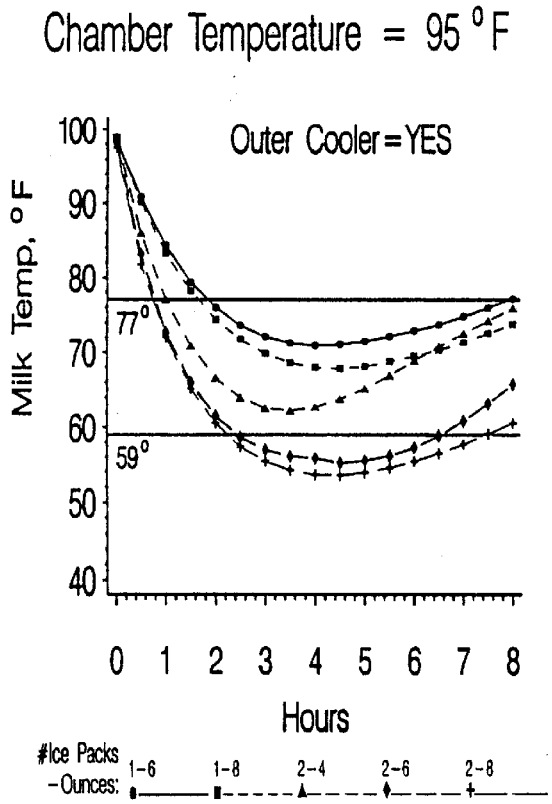
Figure 6O:
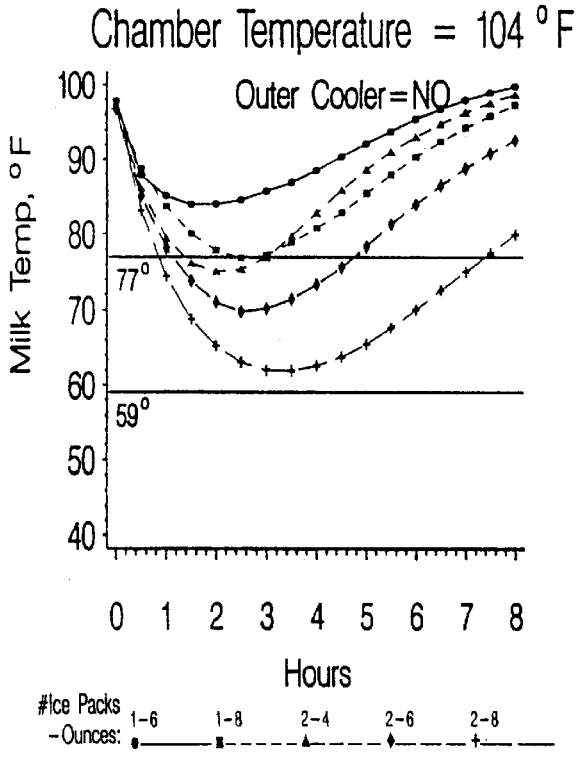
Figure 6P:
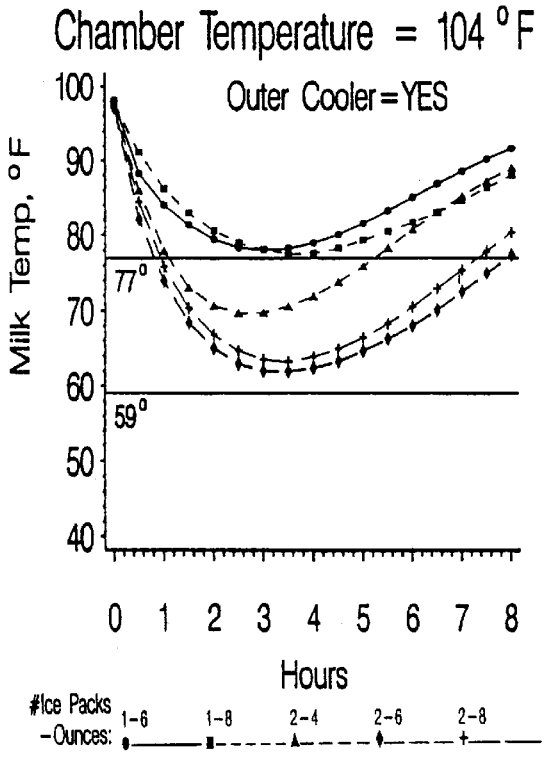

The panels further comprise inner and outer protective coverings 132, 134 sandwiching the intermediate insulation layer 136 as shown in FIG. 4A. The inner and outer covering layers comprise any material suitable to the application. Examples of material used as covering layers include but are not limited to polyvinyl chloride (PVC), natural and man made woven fabrics, plastic, urethane, foil, mylar and combinations thereof. Different materials may be selected depending on the desired characteristics. For example, food grade material may be desired on the inner layer where it may become in contact with foodstuffs. Easy of cleaning, durability and appearance of the article are additional characteristics addressed by the selection of the inner and outer coverings. As with the inner cooler, the panels preferably comprise a polyvinyl chloride vinyl inner 132 and outer layer 134, with a polyurethane foam filler intermediate layer 136. The outer PVC layer 134 has a thickness from about 0.1 mm to about 0.5 mm, preferably from about 0.1 mm to about 0.3 mm. The inner PVC layer 132 has a thickness from about 0.1 mm to about 0.5 mm, preferably from about 0.1 mm to about 0.3 mm. The intermediate polyurethane foam filler layer 136 has a thickness from about 1.0 mm to about 10.0 mm, preferably from about 2 mm to about 8 mm, more preferred from about 4 mm to about 6 mm. Some advantages of PVC in the form of a vinyl sheet are the ease of cleaning and durability characteristics.

Additional support may be provided to the panels of the outer cooler through the inclusion of a stiffening agent such as cardboard, plastic, wood or combinations thereof. The advantage of bottom panel reinforcement is the formation of a solid bottom that supports the coolers in an upright position and provides a solid, flat surface for placement of containers within the coolers. Typically, a piece of cardboard, optionally covered in a protective sheath such as PVC, is sized to sit upon the bottom panel of the container thereby reinforcing the bottom panel.

In accordance with the calculation of R values for the panels of the inner cooler, the R values for the outer cooler panels represent the entire panel's insulation power. Consequently, the total insulation power of the preferred panels of the outer cooler is the sum of the R values for the inner 132 and outer 134 PVC layers and the polyurethane foam filler intermediate layer 136. Since the R values for the preferred PVC layers are negligible compared to the polyurethane foam filler layer, the total R value is suitably approximated by the R value for the polyurethane foam filler layer.

The outer cooler 120 further comprises a closure means for selectively opening and closing the outer cooler 120. The closure means may be any material suitable to the application including but not limited to the hook and loop system such as Velcro™, magnets, spring hinges, snaps, channel lock system with or without a slide such as ZipLoc™, draw string, zippers and combinations thereof. Different materials may be selected depending on the desired characteristics. For example, strength of the seal, cost of material and durability and location of closure means on the article are additional characteristics to be addressed in the selection of suitable closure means. Obviously, the tighter sealing closure means promote better insulation of the interior space by decreasing the exchange of air between the interior space and external environment.

In the embodiment shown in FIG. 4, the preferred closure means is a zipper 138. Affixed to the periphery of the front panel 122 is a zipper track 140 that cooperates with a mating zipper track 142 that is affixed to the periphery of the back panel 124. The zipper ends 138*a* and 138*b* may be left free of the end panels 126, 128, both ends may be attached to the end panels 126, 128 or one zipper end attached and one left free of the end panels 126, 128. The different zipper end options allow for a more or less enclosed interior space. The zipper 138 enables the outer cooler 120 to be selectively opened and closed so that the inner cooler 20, cooling means 12 and perishable foods may be selectively removed and replaced within the outer cooler 120 in addition to minimizing the exchange of cooled air with the external environment.

In a different embodiment shown in FIG. 4B, the preferred closure means, a zipper 138, is affixed to optional top panel 158,160. One edge of top panel half 158 is affixed to the top periphery of front panel 122 with the opposite edge affixed to zipper track 140. One edge of top panel half 160 is affixed to the top periphery of back panel 124 with the opposite edge affixed to a mating zipper track 142. The remaining top panel edges and zipper ends 138*a* and 138*b* are affixed to end panel 126 or 128 respectively. The resulting outer cooler is a fully closed, box-like system when the zipper is closed minimizing the exchange of cooled air with the external environment.

Optionally, the outer cooler 120 further comprises a securing means for securing cooling means adjacent to at least one panel therewithin. The securing means may be any material suitable to the application to include but not limited to the hook and loop system such as Velcro™, straps, buckles, elastic, cord, snaps, pockets and combinations thereof. Different materials may be selected depending on the desired characteristics. For example, space available in the article, strength, location and R value are additional characteristics to be addressed in the selection of suitable securing means for securing cooling means. In the embodiment shown in FIG. 4, the securing means is a third pocket 144 placed adjacent to back panel 124. The third pocket 144 may be made of any material suitable to the application, for example mesh, natural and man made woven fabrics, PVC vinyl, plastic sheets and combinations thereof. Different materials may be selected depending on the desired characteristics. For example, R value, strength and shape are additional characteristics to be addressed in the selection of suitable pocket material. Preferably the securing means is a single sheet of PVC vinyl. The PVC vinyl of the pocket has a thickness from about 0.1 mm to about 0.5 mm, preferably from about 0.1 mm to about 0.3 mm. The configuration of the securing means illustrated in FIG. 4 is one presently preferred embodiment. However, there are other embodiments of the invention in which the securing means is located at an additional and/or a different place within the outer cooler 120. For example, with reference to FIG. 5, an alternate embodiment of the outer cooler 120 includes a fourth pocket 146 placed adjacent to the inside of the front panel 122.

Figure 5:
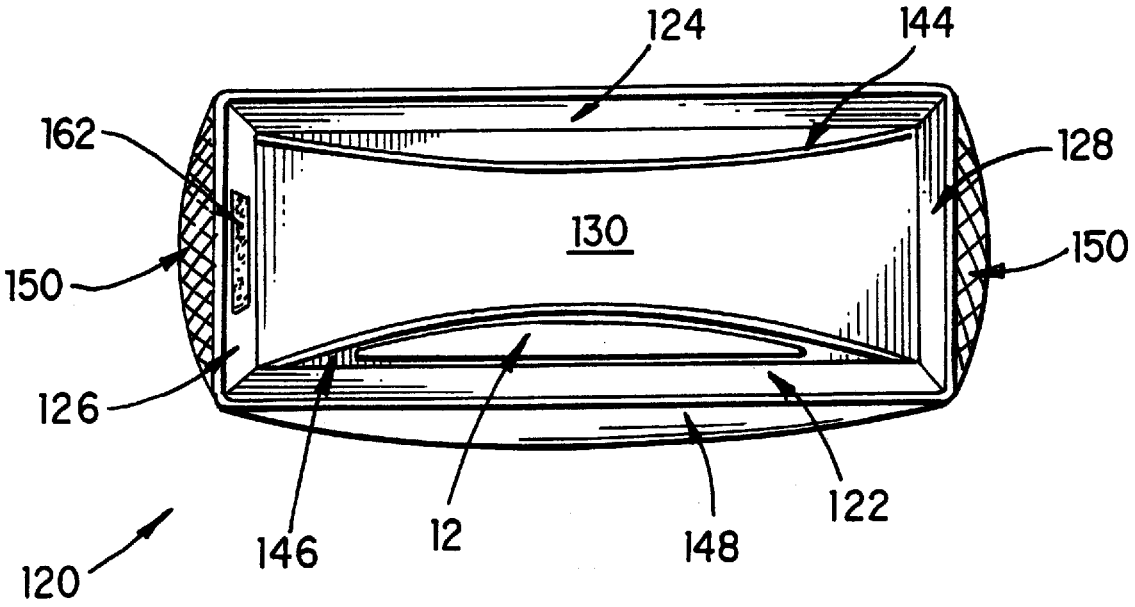
FIG. 5 is a cross section of an alternate embodiment of the outer cooler 120.

With reference to FIG. 5, the optional cooling means is a gel pack 12. The preferred gel pack is available from Mid-Lands Chemical Company, Inc., Omaha, Nebr. and is sold under the trade name "Polar Pack." Preferably, the gel packs are repeatedly frozen and thawed with no appreciable decrease in performance. Other cooling means could also be used successfully, for example, rigid or flexible packs of ice substitute refrigerant, crushed ice, and rigid or flexible chemical coolant packs. Ice substitute refrigerant is typically an inert, nontoxic polymer that forms a lattice. The lattice determines the final viscosity that determines if the end product is a partial or hard freeze gel pack. Obviously, the hard freeze gel packs remain frozen longer and therefore are the preferred gel pack for longer term storage. The optional cooling means is at least one gel pack from about 4 oz. to about 18 oz., preferably at least one gel pack from about 6 oz. to about 16 oz., more preferably at least one gel pack from about 6 oz. to about 8 oz. For the most preferred cooler means, as illustrated in FIG. 5, one eight ounce gel pack is placed in pocket 144.

Additional securing means to secure other items may be added to the outer cooler (shown in FIG. 4) as a fifth 148 and sixth pocket 150 placed on the outside of the outer cooler 120 along front panel 122 and end panel 126, respectively. Optionally, an additional end pocket is placed adjacent to the other end panel 128. The end panel pocket 150 may be made of any material suitable to the application, for example mesh, natural and man made woven fabrics, PVC vinyl, plastic sheet, closed cell foam, open cell foam, fiber insulators, airspace, mylar, glass and combinations thereof. Different materials may be selected depending on the desired characteristics. For example, R value, strength, shape and appearance are additional characteristics to be addressed in the selection of suitable pocket material. Preferably the securing means 150 is a mesh pocket of polyester and polypropylene. Obviously, an increase in R value of the end panels (126,128) may be achieved by adding insulation to the end panel packets 150.

The fifth pocket 148 is adjacent to the outer layer of either the front 122 or back panel 124 or both. The fifth pocket 148 may be made of any material suitable to the application, for example mesh, natural and man made woven fabrics, PVC vinyl, plastic sheet, closed cell foam, open cell foam, fiber insulators, air space, mylar, glass and combinations thereof. Different materials may be selected depending on the desired characteristics. For example, R value, strength, shape and appearance are additional characteristics to be addressed in the selection of suitable pocket material. Preferably, as with the panels of the outer cooler, the fifth pocket 148 comprises a polyvinyl chloride vinyl inner 132 and outer layer 134, with a polyurethane foam filler intermediate layer 136. The outer PVC layer 134 has a thickness from about 0.1 mm to about 0.5 mm, preferably from about 0.1 mm to about 0.3 mm. The inner PVC layer 132 has a thickness from about 0.1 mm to about 0.5 mm, preferably from about 0.1 mm to about 0.3 mm. The intermediate polyurethane foam filler layer 136 has a thickness from about 1.0 mm to about 10.0 mm, preferably from about 2 mm to about 8 mm, more preferred from about 4 mm to about 6 mm. The resultant R value of the front 122 or back panel 124 would be increased with the addition of an insulated pocket.

Optionally, the external pockets 148, 150 have closure means for selectively opening and closing the external pockets. The closure means may be any material suitable to the application to include but not limited to the hook and loop system such as Velcro™, magnets, channel lock system with or without a slide such as Ziploc™, draw string, elastic, zippers, snaps and combinations thereof. Different materials may be selected depending on the desired characteristics. For example, strength of the seal, cost of material, durability and location of closure means on the pocket are additional characteristics to be addressed in the selection of suitable closure means. The preferred optional closure means is a hook and loop system with half of the hook and loop system affixed to the inside of the pocket and the other half of the hook and loop system affixed to the outer layer of the panels positioned so as to contact each other.

An adjustable shoulder strap 152 and handles 154 provide for ease of transport of the nested cooler system. Shoulder strap end 152*a* is affixed to end panel 126 while shoulder strap end 152*b* is affixed to end panel 128. A set of handles 154 are attached to the front and back panels 122, 124. Each handle 154 and strap 152 attachment preferably withstand at least a 35 lb. pull without tearing. The handle 154 and strap 152 may be made of any material suitable to the application, to include but not limited to PVC, natural and man made woven fabric, plastic, wood, metal, webbing and combinations thereof. Different materials may be selected depending on the desired characteristics. For example, comfort of the handle or shoulder strap, strength and appearance are additional characteristics to be addressed in the selection of suitable handle or shoulder strap material. The preferred material for the handle 154 and strap 152 is one inch wide polypropylene webbing.

An optional identification label 156 is affixed to the inner layer of the back panel 124. The label may be any material suitable to the application to include but not limited to PVC, natural and man made woven fabrics, paper, plastic, ink stamped onto the inner layer, embossing of the inner layer and combinations thereof. Different materials may be selected depending on the desired characteristics. For example, appearance, durability and ability to accept ink are additional characteristics to be addressed in the selection of suitable identification label material.

Optionally, the outer cooler may further comprise securing means for securing the inner cooler within the interior space of the outer cooler. Those knowledgeable in the art may use any securing means suitable to the application. Optional securing means may include but are not limited to the hook and loop system such as Velcro™, straps, snaps, buckles, elastic, cord, and pockets and combinations thereof. Different materials may be selected depending on the desired characteristics. For example, space available in the article, strength, location and R value are additional characteristics to be addressed in the selection of suitable securing means for securing the inner cooler within the interior space of the outer cooler. Preferably, the inner cooler is held in correct orientation by a hook and loop system. One half of the hook and loop system is affixed to the outer layer 36 of an inner cooler 20 panel and the other half of the hook and loop system is affixed to the inner layer 132 of a outer cooler 120 panel. The advantage is an inner cooler positioned such that a non-insulated panel is placed adjacent to the optional cooling means in the outer cooler and the added security of ensuring that containers within the inner cooler are stored in the upright position.

The inventive article provides great utility and convenience for multiple cooling tasks to the large number of mothers temporarily unavailable to a nursing infant, either due to employment commitments or other requirements of their schedule.

As illustrated by the test results in Examples I–III, the nested cooler system provides excellent performance. Extensive testing has been made on the configuration of the inner and outer cooler individually and together that would yield the best results.

EXAMPLE I

The cooling capacity of a complete Nested Cooler System made in accordance with the invention and two 8-oz. frozen gel packs inserted in the inner cooler and the Mead Johnson® Breastfeeding Success bag (hereinafter MJ bag) with the manufacturer supplied single 16-oz frozen ice pack at four different environmental temperatures with milk initially at three different temperatures is described below.

Methods

The tests were conducted in temperature-controlled environmental chambers by an independent testing laboratory (Insulated Shipping Containers, Inc., Pheonix Ariz.). Each Nested Cooler System contained an inner cooler with two 8 oz. frozen Polar Packs (Mid-Lands Chemical Company, Inc., Omaha, Nebr.) and three 4-fl-oz. plastic bottles filled with whole cow's milk. One frozen gel pack was placed upright in each of the two side pockets inside the inner cooler. Each MJ Bag contained a single 16-oz frozen gel pack, that was placed in the bottom compartment of the bag.

Three 4-fl-oz milk storage bottles filled with whole cow's milk were also placed in the bottom compartment, in an upright position on top of the ice pack. Pasteurized whole cow's milk was used in place of human milk. Since human milk and cow's milk are similar in osmolality, the thermal properties of the cow's milk closely approximates those of human milk.

Each environmental chamber was maintained at a constant temperature during the study. The ambient temperatures selected for the study were 71.6° F. (22° C.),86° F. (30° C.),95° F. (35° C.) and 104° F. (40° C.). All gel packs were stored for a minimum of 24 hours at −0.4° F. (−18° C.) and were immediately placed into the coolers at the start of each test. In addition, the Nested Cooler System and the MJ bag were stabilized at 71.6° F. (22° C.) for a minimum of 24 hours before testing. Each environmental chamber contained three nested cooler systems or three MJ bags: one containing milk initially at freezer temperature 14° F.(−10° C.), the second contained milk initially at refrigerator temperature 39.2° F. (4° C.), and the third contained milk initially at body temperature 98.6° F. (37° C.). Thus, milk at three different initial temperatures was tested in each of four ambient temperatures.

The temperature of the milk in two of the three bottles in each cooler was monitored over two 8-hour periods. Temperatures were measured by inserting a 6-in. T-shape thermocouple probe (Omega Engineering, Stamford, Conn.) into the midpoint of the milk in each of these bottles. Milk temperature was recorded at the start of each 8 hour test period and every 30 minutes thereafter, generating 17 temperature readings for the milk in the bottle.

Two eight-hour tests were conducted under the same conditions, and the average of these temperature readings was calculated. The coolers remained closed and were placed randomly within the environmental chambers during the study.

Results

The criteria used to evaluate the performance of the two cooling systems were based on studies carried out by Hamosh, et al., "Breastfeeding and the Working Mother: Effect of Time and Temperature of Short Term Storage on Proteolysis Lipolysis and Bacterial Growth in Milk", PEDIATRICS, Vol. 97, Pages 492–498 (1996). Hamosh, et al., evaluated the safety of stored human milk at various temperatures by assessing the microbial growth and stability of the milk protein and lipid at intervals up to 24 hours. They found that human milk can be stored safely up to 24 hours at 59° F. (15° C.) and for up to four hours at 77° F. (25° C.) but that it should not be stored at 100.4° F. (38° C.).

Table 1 lists the mean temperature of the milk after eight hours of storage for each chamber temperature, at each initial milk temperature for the Nested Cooler System and the MJ bag.

TABLE 1

Milk mean temperature after eight hours of storage in the Nested Cooler System and MJ bag for each chamber temperature and each milk temperature

| | | Initial Milk Temperature (° F.) | | |
|---|---|---|---|---|
| Environmental Temperature (° F.) | Cooler System | 14 (Freezer Temp.) | 39.2 (Refrigerator Temp.) | 98.6 (Body Temp.) |
| 71.6 | Nested cooler | 30.9 | 42.2 | 43.9 |
| | MJ bag | 35 | 60.5 | 59.8 |
| 86 | Nested cooler | 30.4 | 47.7 | 54.5 |
| | MJ bag | 50.9 | 64.1 | 67.3 |
| | Nested cooler | 32.2 | 52.1 | 60.5 |
| | MJ bag | 59 | 72.9 | 74.3 |
| 104 | Nested cooler | 38.8 | 61.7 | 80.3 |
| | MJ bag | 72.3 | 78.8 | 85.8 |

The nested Cooler System with two 8-oz. gel packs in the inner cooler performed better than the single compartment MJ bag with larger cooling source (16-oz.) under every condition tested. Table 2 shows the time intervals during the eight-hour test periods in which milk in the cooling systems met the Hamosh, et al., criteria for safe storage (up to 24 hours at 59° F. and up to 4 hours at 77° F.).

TABLE 2

Cooling capacity study results for the Nested Cooler System and MJ bag compared to criteria of Hamosh, et al. for safe storage

| Environmental Temperature (° F.) | Cooler System | Initial Milk Temperature (° F.) 14 (Freezer Temp.) | 39.2 (Refrigerator Temp.) | 98.6 (Body Temp.) |
|---|---|---|---|---|
| 71.6 | Nested coolers | <59 for entire 8 hours | <59 for entire 8 hours | <77 after 1 hour <59 after 1.5 hours |
| | MJ bag | <59 for entire 8 hours | <59 for 6.5 hours | <77 after 1.5 hour <59 at 5.5 to 6.5 hours |
| 86 | Nested coolers | <59 for entire 8 hours | <59 for entire 8 hours | <77 after 1 hour <59 after 2 hours |
| | MJ bag | <59 for entire 8 hours | <59 for 2.5 hours | <77 after 2 hours Never < 59 |
| 95 | Nested coolers | <59 for entire 8 hours | <59 for entire 8 hours | <77 after 1 hour <59 at 2.5 to 7 hours |
| | MJ bag | <59 for 7.5 hours | <59 for 2 hours | <77 after 1.5 hour Never <59 |
| 104 | Nested coolers | <59 for entire 8 hours | <59 for 7 hours | <77 at 1 to 7 hours Never < 59 |
| | MJ bag | <59 for 6 hours | <59 for 1.5 hours >77 after 7.5 hours | Never < 77 |

The most challenging conditions for both the Nested Cooler System and the single compartment MJ bag was the cooling of expressed milk with initial milk temperature of 98.6° F. FIGS. 6 A–D plot the 98.6° F. milk data against the Hamosh, et al., criteria for safe storage. The Nested Cooler System was able to decrease the milk temperature to below 59° F. at all storage temperatures with the exception of the 104° F., while the single compartment MJ bag did not achieve the 59° F. target at storage temperatures above 86° F. In every chamber the Nested Cooler System more rapidly decreased the milk temperatures than the single compartment MJ bag.

EXAMPLE II

The study as described in Example I was carried out on the inner cooler with one 8-oz frozen gel pack and the outer cooler with two 8-oz frozen gel packs.

The mean temperature of the milk stored in the inner cooler after eight hours for all chamber temperatures and all time measurements ranged from 26.8 to 29.0° F. for milk that started out frozen(14° F.), from 47.2 to 64.8° F. for milk that started out at refrigerated temperature (39.2° F.) and from 60.9 to 94.0° F. for milk that started out at body temperature (98.6° F.). The mean temperature of the milk stored in the outer cooler after eight hours for all chamber temperatures and all time measurements ranged from 26.1 to 27.2° F. for milk that started out frozen(14° F.), from 43.3 to 58.0° F. for milk that started out at refrigerated temperature (39.2° F.) and from 50.4 to 84.1° F. for milk that started out at body temperature (98.6° F.). Table 3 and 4 shows the time intervals during the eight-hour test periods in which milk stored in the inner or outer cooler met the Hamosh, et al., criteria for safe storage.

TABLE 3

Cooling capacity study results for the inner cooler with one 8-oz gel pack compared to criteria of Hamosh, et al., for safe storage

| Environmental Temperature (° F.) | Initial Milk Temperature (° F.) 14 (Freezer Temp.) | 39.2 (Refrigerator Temp.) | 98.6 (Body Temp.) |
|---|---|---|---|
| 71.6 | <59 for entire 8 hours | <59 for entire 8 hours | <77 after 1 hour never < 59 |
| 86 | <59 for entire 8 hours | <59 for 5 hours | <77 after 1.5 hours never<59 |
| 95 | <59 for entire 8 hours | <59 for 3 hours | <77 after 2.O hours never < 59 |
| 104 | <59 for entire 8 hours | <59 for 2 hours | never < 77 never < 59 |

The most challenging conditions for the inner cooler was the cooling of expressed milk with initial milk temperature of 98.6° F. FIGS. 6 E–H plot the 98.6° F. milk data for the inner and outer cooler against the Hamosh, et al., criteria for safe storage. The inner cooler with one gel pack was able to decrease the milk temperature to below 77° F. at all storage temperatures with the exception of 104° F.

TABLE 4

Cooling capacity study results for the outer cooler with two 8-oz gel packs compared to criteria of Hamosh, et al., for safe storage

| Environmental Temperature (° F.) | Initial Milk Temperature (° F.) 14 (Freezer Temp.) | 39.2 (Refrigerator Temp.) | 98.8 (Body Temp.) |
|---|---|---|---|
| 71.6 | <59 for entire 8 hours | <59 for entire 8 hours | <77 after 1 hour <59 after 2.5 hours |
| 86 | <59 for entire 8 hours | <59 for 7.5 hours | <77 after 1 hour <59 after 3.5 hours |
| 95 | <59 for entire 8 hours | <59 for entire 8 hours | <77 after 1 hour <59 after 4 hours |
| 104 | <59 for entire 8 hours | <59 for 4 hours >77 for 0.5 hours | <77 after 1 hour never 59 |

The most challenging conditions for the outer cooler was the cooling of expressed milk with initial milk temperature of 98.6° F. The outer cooler with two gel packs was able to decrease the milk temperature to below 59° F. in all chamber temperatures with the exception of the 104° F. chamber. However the outer cooler was able to decrease the milk temperature below 77° F. after one hour in the 104° F. chamber. The milk temperature remained below 77° F. until the final hour of the eight-hour test. In every chamber the inner and outer cooler were able to bring the initial milk temperature of 98.6° F. below 77° F. at about the same rates. However, the outer cooler with two 8-oz gel packs out performed the inner cooler alone with one 8-oz gel pack by decreasing the milk temperature to below 59° F. in every chamber with the exception of the 104° F. chamber.

EXAMPLE III

The studies to evaluate the cooling capacity of the nested cooler system when using alternate gel pack sizes (4, 6, 8 oz.) and one or two gel packs followed the study design described in Example I. The variables tested included 1–6 oz. gel pack, 1–8 oz. gel pack, 2–4 oz. gel packs, 2–6 oz. gel packs, 2–8 oz. gel packs inserted in the inner cooler alone or nested within the outer cooler. Table 5 lists mean milk temperatures after eight hours of storage in the inner cooler alone with different gel packs for each chamber temperature and each milk temperature.

TABLE 5

Milk mean temperature after eight hours of storage in the inner cooler with different gel packs for each chamber temperature and each milk temperature

| Environmental Temperature (° F.) | Gel Packs | Initial Milk Temperature (° F.) 14 (Freezer Temp.) | 39.2 (Refrigerator Temp.) | 98.6 (Body Temp.) |
|---|---|---|---|---|
| 71.6 | 1–6 oz gel pack | 33.2 | 61.6 | 64.9 |
| | 1–8 oz gel pack | 31.8 | 59.6 | 63 |
| | 2–4 oz gel packs | 34 | 60.1 | 65.1 |
| | 2–6 oz gel packs | 33 | 52.3 | 57.7 |
| | 2–8 oz gel packs | 32 | 48.7 | 52.1 |
| 86 | 1–6 oz gel pack | 48.4 | 72.7 | 78.9 |
| | 1–8 oz gel pack | 46.4 | 70.9 | 78.5 |
| | 2–4 oz gel packs | 37.3 | 72.3 | 77.3 |
| | 2–8 oz gel packs | 36.1 | 61.7 | 72.5 |
| | 2–8 oz gel packs | 32.6 | 58 | 64.8 |
| 95 | 1–6 oz gel pack | 48.7 | 77.7 | 82.9 |
| | 1–8 oz gel pack | 47 | 76.3 | 81.1 |
| | 2–4 oz gel packs | 45.2 | 76 | 83.3 |
| | 2–6 oz gel packs | 39.9 | 70.5 | 79 |
| | 2–8 oz gel packs | 38.7 | 63.6 | 74.2 |
| 104 | 1–6 oz gel pack | 70.7 | 96.2 | 99.8 |
| | 1–8 oz gel pack | 73 | 94.6 | 97:3 |
| | 2–4 oz gel packs | 65.9 | 93.3 | 98.7 |
| | 2–6 oz gel packs | 57.1 | 86.8 | 92.6 |
| | 2–8 oz gel packs | 57.9 | 75.4 | 79.9 |

FIGS. 6 I–P plot the 98.6° F. milk data for the inner cooler alone and the nested cooler system against the Hamosh, et al., criteria for safe storage. All the different gel pack combinations decreased the temperature of the 98.6° F. milk stored in the inner cooler, the largest effect on temperature was achieved with the 2–8 oz. gel packs and the least effect on temperature was achieved with 1–6 oz. gel pack. Table 6 lists mean milk temperatures after eight hours of storage in the nested cooler system with different gel packs in the inner cooler for each chamber temperature and each milk temperature.

TABLE 6

Milk mean temperature after eight hours of storage in the Nested Cooler System with different gel packs in the inner cooler for each chamber temperature and each milk temperature

| Environmental Temperature (° F.) | Gel Packs | Initial Milk Temperature (° F.) 14 (Freezer Temp.) | 39.2 (Refrigerator Temp.) | 98.6 (Body Temp.) |
|---|---|---|---|---|
| 71.6 | 1–6 oz gel pack | 32.9 | 55.1 | 59.3 |
| | 1–8 oz gel pack | 33 | 53.5 | 56.7 |
| | 2–4 oz gel packs | 32 | 50.8 | 57.8 |
| | 2–6 oz gel packs | 31.5 | 44.7 | 47.6 |
| | 2–8 oz gel packs | 30.9 | 42.2 | 43.9 |
| 86 | 1–6 oz gel pack | 38.4 | 64 | 73 |
| | 1–8 oz gel pack | 31.5 | 62.1 | 72.2 |
| | 2–4 oz gel packs | 31.6 | 60.9 | 68 |
| | 2–6 oz gel packs | 32.5 | 52.7 | 59.5 |
| | 2–8 oz gel packs | 30.4 | 47.7 | 54.5 |
| 95 | 1–6 oz gel pack | 40.6 | 69.5 | 77.1 |
| | 1–8 oz gel pack | 35.3 | 65.9 | 73,8 |
| | 2–4 oz gel packs | 35.9 | 85.9 | 75.9 |
| | 2–6 oz gel packs | 36.1 | 61.7 | 65.7 |
| | 2–8 oz gel packs | 32.2 | 52.1 | 60.5 |
| 104 | 1–6 oz gel pack | 52 | 85.6 | 91.7 |
| | 1–8 oz gel pack | 48.9 | 82 | 88 |
| | 2–4 oz gel packs | 46.4 | 82.4 | 89 |
| | 2–6 oz gel packs | 39.3 | 70.8 | 77.4 |
| | 2–8 oz gel packs | 38.8 | 61.7 | 80.3 |

The Nested Cooler System performed better than the inner cooler alone at every storage temperature. The data split into two groupings upon the addition of the outer cooler. The 1–6 oz. and 1–8 oz. gel pack sample results were similar. While the 2–6.oz. and 2–8 oz. gel pack sample results were similar. The 24 oz. gel pack sample results fell between the other two data groupings. Interestingly, the 2–4 oz. gel pack data would start out similar to the two gel pack data and as time passed the data was more similar to the one gel pack data. The additional insulation of the outer cooler diminishes the differences observed between the two single gel pack variables and also between the two double gel pack variables. Consequently, the selection of gel pack size for a desired result is less critical in the nested cooler system.

As illustrated by the results of the cooling capacity tests in Examples I–III, the inner cooler alone and nested cooler system provide excellent performance by satisfying the Hamosh, et al., criteria for safe storage of breast milk under a broad range of temperatures. The nested cooler system can help health care professionals promote breast feeding by addressing mothers, who are expressing breast milk, concerns about a convenient, safe and reliable storage of the milk. The added convenience of being able to insert the inner cooler in the outer cooler for transport of additional perishable foodstuffs and baby support items makes the nested cooler system suitable for multitasks.

The invention has been described with reference to a preferred embodiment, obviously, modifications and alternations will occur to others upon a reading and understanding of the this specification. It is intended to include all such modifications and alterations in so far as they come within the scope of the appended claims or the equivalents thereof.

What is claimed is:

1. A nested cooler system comprising:

(a) an inner cooler having (i) a plurality of panels defining a first interior space, and (ii) at least one cooling means; and (b) an outer cooler having a plurality of panels defining a second interior space, wherein said inner cooler and said second interior space are dimensioned such that said inner cooler can be removably inserted into said second interior space; and wherein one or more of said inner cooler panels comprise insulating material with an R value of at least about 0.29.

2. The nested cooler system of claim 1 wherein one or more of said inner cooler panels comprise insulating material with an R value of at least about 0.58.

3. The nested cooler system of claim 1 wherein said R value is from about 0.29 to about 5.0.

4. The nested cooler system of claim 1 wherein one or more of said inner cooler panels further comprise (i) an outer protective layer of polyvinyl chloride from about 0.1 mm to about 0.5 mm thick and (ii) an inner protective layer of polyvinyl chloride from about 0.1 mm to about 0.5 mm thick that sandwich (iii) an intermediate layer of polyurethane foam filler from about 1.0 mm to about 10.0 mm thick.

5. The nested cooler system of claim 1 wherein one or more of said outer cooler panels further comprise (i) an outer protective layer of polyvinyl chloride from about 0.1 mm to about 0.5 mm thick and (ii) an inner protective layer of polyvinyl chloride from about 0.1 mm to about 0.5 mm thick that sandwich (iii) an intermediate layer of polyurethane foam filler from about 1.0 mm to about 10.0 mm thick.

6. The nested cooler system of claim 1 wherein said cooling means is selectively removable from said inner cooler.

7. The nested cooler system of claim 1 wherein said inner cooler further comprises at least one securing means for said cooling means.

8. The nested cooler system of claim 1 wherein said outer cooler further comprises (i) at least one cooling means, and (ii) at least one securing means for said cooling means within said second interior space.

9. The nested cooler system of claim 8 wherein said cooling means is selectively removable from said outer cooler.

10. The nested cooler system of claim 8 wherein a securing means for securing said inner cooler within said second interior space is placed so that said inner cooler is juxtaposed near said cooling means of the outer cooler.

11. The nested cooler system of claim 1 wherein one or more of said outer cooler panels comprise insulating material with an R value of at least about 0.29.

12. The nested cooler system of claim 11 wherein said R value is from about 0.29 to about 5.0.

13. The nested cooler system of claim 1 wherein said outer and inner cooler each comprise closure means for selectively opening and closing said inner and outer cooler.

14. The nested cooler system of claim 1 wherein said outer cooler further comprises external securing means for securing additional items near said outer cooler panels.

15. The nested cooler system of claim 14 wherein said external securing means is a pocket.

16. The nested cooler system of claim 14 wherein said external securing means is a pocket that further comprises a closure means for selectively opening and closing said pocket.

17. A nested cooler system comprising:

(a) an inner cooler comprising (i) a floor, four side panels and a top defining a first interior space, (ii) a closure means, (iii) at least one reusable gel-pack cooling means; and (b) an outer cooler comprising a floor, four side panels and a top defining a second interior space, wherein said inner cooler and said second interior space are dimensioned such that said inner cooler can be removably inserted into said second interior space; and wherein one or more of said inner cooler floor, four side panels and top comprise insulating material with an R value of at least about 0.29.

18. The nested cooler system of claim 17 wherein one or more of said inner cooler floor, four side panels and top comprise insulating material with an R value of at least about 0.58.

19. The nested cooler system of claim 17 wherein said R value is from about 0.29 to about 5.0.

20. The nested cooler system of claim 17 wherein one or more of said outer cooler floor, four side panels and top comprise insulating material with an R value of at least about 0.29.

21. The nested cooler system of claim 20 wherein said R value is from about 0.29 to about 5.0.

22. The nested cooler system of claim 17 wherein one or more of said inner cooler floor, four side panels and top further comprise;

(i) an outer protective layer of polyvinyl chloride from about 0.1 mm to about 0.5 mm thick, (ii) an inner protective layer of polyvinyl chloride form about 0.1 mm to about 0.5 mm thick that sandwich, and, (iii) an intermediate layer of polyurethane foam filler from about 1.0 mm to about 10.0 mm thick.

23. The nested cooler system of claim 17 wherein one or more of said outer cooler floor, four side panels and top further comprise;

(i) an outer protective layer of polyvinyl chloride from about 0.1 mm to about 0.5 mm thick, (ii) an inner protective layer of polyvinyl chloride form about 0.1 mm to about 0.5 mm thick that sandwich, and, (iii) an intermediate layer of polyurethane foam filler from about 1.0 mm to about 10.0 mm thick.

24. The nested cooler system of claim 17 wherein said outer cooler further comprises closure means for selectively opening and closing said outer cooler.

25. The nested cooler system of claim 17 wherein said outer cooler further comprises one or more external securing means for securing additional items near said side panels.

26. The nested cooler system of claim 25 wherein said external securing means is a pocket.

27. The nested cooler system of claim 25 wherein said external securing means is a pocket that further comprises a closure means for selectively opening and closing said pocket.

* * * * *